US009901798B1

(12) United States Patent
Roy

(10) Patent No.: US 9,901,798 B1
(45) Date of Patent: Feb. 27, 2018

(54) GOLF CLUB STAND

(71) Applicant: Michael A. Roy, Southampton, MA (US)

(72) Inventor: Michael A. Roy, Southampton, MA (US)

( * ) Notice: Subject to any disclaimer, the term of this patent is extended or adjusted under 35 U.S.C. 154(b) by 0 days.

(21) Appl. No.: 15/601,082

(22) Filed: May 22, 2017

Related U.S. Application Data

(60) Provisional application No. 62/339,127, filed on May 20, 2016.

(51) Int. Cl.
*A63B 55/10* (2006.01)
*A63B 60/62* (2015.01)

(52) U.S. Cl.
CPC ..... *A63B 60/62* (2015.10); *A63B 55/10* (2013.01)

(58) Field of Classification Search
CPC ..... A63B 60/62; A63B 55/10; F16M 11/06; F16M 11/08; F16M 11/10; A45F 3/44
USPC ..... 473/282–286, 406; 248/156, 511–541, 248/685, 686, 688; 294/19.2
See application file for complete search history.

(56) References Cited

U.S. PATENT DOCUMENTS 4,210,334 A 7/1980 Lind
4,545,579 A 10/1985 McCain
4,805,911 A 2/1989 Ferlazzo et al.
4,991,839 A 2/1991 Lumbattis, Jr.
5,087,044 A * 2/1992 Okushima ..... A63B 53/14 473/285
5,116,046 A 5/1992 Pace
5,125,657 A 6/1992 Beil
5,171,015 A 12/1992 Vale
5,624,328 A 4/1997 Lovich
D382,929 S 8/1997 DeBlieux et al.
5,782,443 A 7/1998 La Fontaine
5,813,414 A 9/1998 Zutler et al.
D414,537 S 9/1999 Crate
6,159,107 A 12/2000 Walton
6,390,931 B1 5/2002 Berndt
6,482,103 B1 11/2002 Vache
6,964,618 B2 11/2005 Klein
7,351,156 B1 * 4/2008 Panneri ..... A63B 57/10 473/132
7,611,421 B2 11/2009 Brewer et al.
8,414,415 B1 4/2013 Twohig
(Continued)

OTHER PUBLICATIONS

"Green Buddy Switchblade Golf Tool," Green Buddy, greenbuddy.com, Oct. 19, 2014. https://web.archive.org/web/20141019043235/http://greenbuddy.com/home.html.
(Continued)

*Primary Examiner* — Sebastiano Passaniti
(74) *Attorney, Agent, or Firm* — Doherty, Wallace, Pillsbury & Murphy, P.C.

(57) ABSTRACT

A golf club stand used for elevating a golf club handle above the ground. The golf club stand includes a rod disposed through and slidably engaged with a mount. An anterior terminal end of the rod extends from one side of the mount, while an oppositely situated posterior terminal end extends from an opposite side of the mount. The rod may extend both vertically and horizontally from the mount. The golf club stand further comprises a cap which is fixedly secured to the anterior terminal end of the rod, and which is removably engaged with the mount.

11 Claims, 24 Drawing Sheets

(56) References Cited

U.S. PATENT DOCUMENTS

| | | | | |
|---|---|---|---|---|
| 8,424,943 | B2 * | 4/2013 | Harris | B25J 1/04 294/190 |
| 8,540,585 | B2 | 9/2013 | Robinson | |
| 8,628,429 | B2 | 1/2014 | Karcher | |
| 2007/0219012 | A1 * | 9/2007 | Merriman | A63B 57/50 473/286 |
| 2007/0298900 | A1 * | 12/2007 | Johnson | A63B 57/207 473/286 |
| 2013/0237338 | A1 * | 9/2013 | Pak | A63B 53/14 473/285 |
| 2016/0474722 | | 3/2016 | Rogers et al. | |

OTHER PUBLICATIONS

"GRIP-DRY golf accessory," Amazon, amazon.com, ASIN: B001R5F63S, accessed: Jun. 2016. https://www.amazon.com/Dry-Grip-GRIP-DRY-golf-accessory/dp/B001R5F63S.

"Putter Prop Snap on Golf Club Stand Keeps Grips Dry," Amazon, amazon.com, ASIN: B0026EGNYU, accessed: Jun. 2016. http://www.amazon.com/Putter-Prop-Snap-Stand-Grips/dp/B0026EGNYU/ref-cm_cr_arp_d_product_top.

* cited by examiner

GOLF CLUB STAND

BACKGROUND TO THE INVENTION

1. Field of the Invention

The present disclosure generally relates to the field of golf club accessories, and more particularly to a golf club stand.

2. Background of the Invention

Many golfers now use motorized carts to navigate a golf course, but many golf course owners discourage or prohibit golfers from driving motorized carts to the immediate location of the golfer's ball after a shot. This is especially true if the golf course grass has become saturated with water. Driving motorized carts on saturated grass can cause damage. Therefore many golf courses require golfers to keep the motorized vehicles upon designated cart paths. At times, this requires the golfer to walk a moderate distance to get to their ball.

Often, when a golfer begins the walk from the cart to the ball, the golfer may be unsure as to which of many golf clubs will be needed for the next golf shot. As a result, the golfer is forced to bring more than one club along as the golfer walks to the golf ball to take the next shot. Often, golfers are forced to bring more than one club with them if their ball is near a "green" but not yet on the green (a "green" is a section of very short grass where the target hole is located). In this case, the golfer will usually bring a putting club and a chipping club. This is true even though the golfer probably knows exactly which club(s) will be used for all of the remaining shots. This is because motorized golf carts are generally disallowed within a short distance of the green regardless of the condition of the grass.

As a golfer approaches the ball with more than one golf club, the golfer is forced to choose which golf club to use to swing at the ball for the next shot. Because the golfer is away from the location of the golf club bag, the golfer must place the unselected golf club(s) upon the ground while taking the next swing at the golf ball with the selected club. The placement of the unselected club(s) upon the ground often causes dirt, gravel, sand, water and other debris to accumulate on the handle or "grip" portion of the golf club. This is especially true in the morning when dew readily accumulates upon surfaces that touch the ground. Many golfers dislike debris or moisture upon the grip of their golf clubs.

SUMMARY OF THE INVENTION

The above-mentioned problems of the prior art are overcome or eliminated by a golf club stand used for elevating a golf club handle above the ground. The golf club stand includes a rod disposed through a mount, wherein the rod is slidably engaged with the mount. An anterior terminal end of the rod extends from one side of the mount, while an oppositely situated posterior terminal end extends from an opposite side of the mount. The stand further comprises a cap which is fixedly secured to the anterior terminal end of the rod, and which is removably engaged with the mount.

In an exemplary embodiment, the golf club stand may be engaged with a golf club by disposing the mount within a cavity of a handle of the golf club such that a peripheral wall of the mount physically abuts an interior side wall of the handle of the golf club, such that the rod is disposed within the cavity and the cap is directed away from the golf club.

In another exemplary embodiment, the golf club stand may be engaged with the golf club by inserting a protrusion which extends from a bottom side of the mount through the top side of the handle of the golf club such that the rod is oriented towards the cavity of the golf club and is movable therein, and such that the bottom side of the mount rests on the top side of the handle of the golf club.

In either embodiment, when the golf club stand is in use, the cap is removed from the mount, thereby causing the rod to extend from the mount in a direction opposite to a head of the golf club via a vertically extending channel formed through the mount. The posterior terminal end of the rod has a stop member formed thereon, wherein the stop member and the mount are configured such that the rod cannot be released from the mount. Once the stand is in such an extended position, the rod may be engaged within a slot that is formed substantially perpendicularly to the vertically extending channel. In this position, the golf club may be supported by the golf club stand, and the handle of the golf club is raised relative to the ground.

For a better understanding of the invention, its operating advantages and the specific objects attained by its uses, reference should be made to the accompanying drawings and descriptive matter in which there are illustrated preferred, but not exclusive, embodiments of the invention.

DETAILED DESCRIPTION OF THE INVENTION

Figure 1:
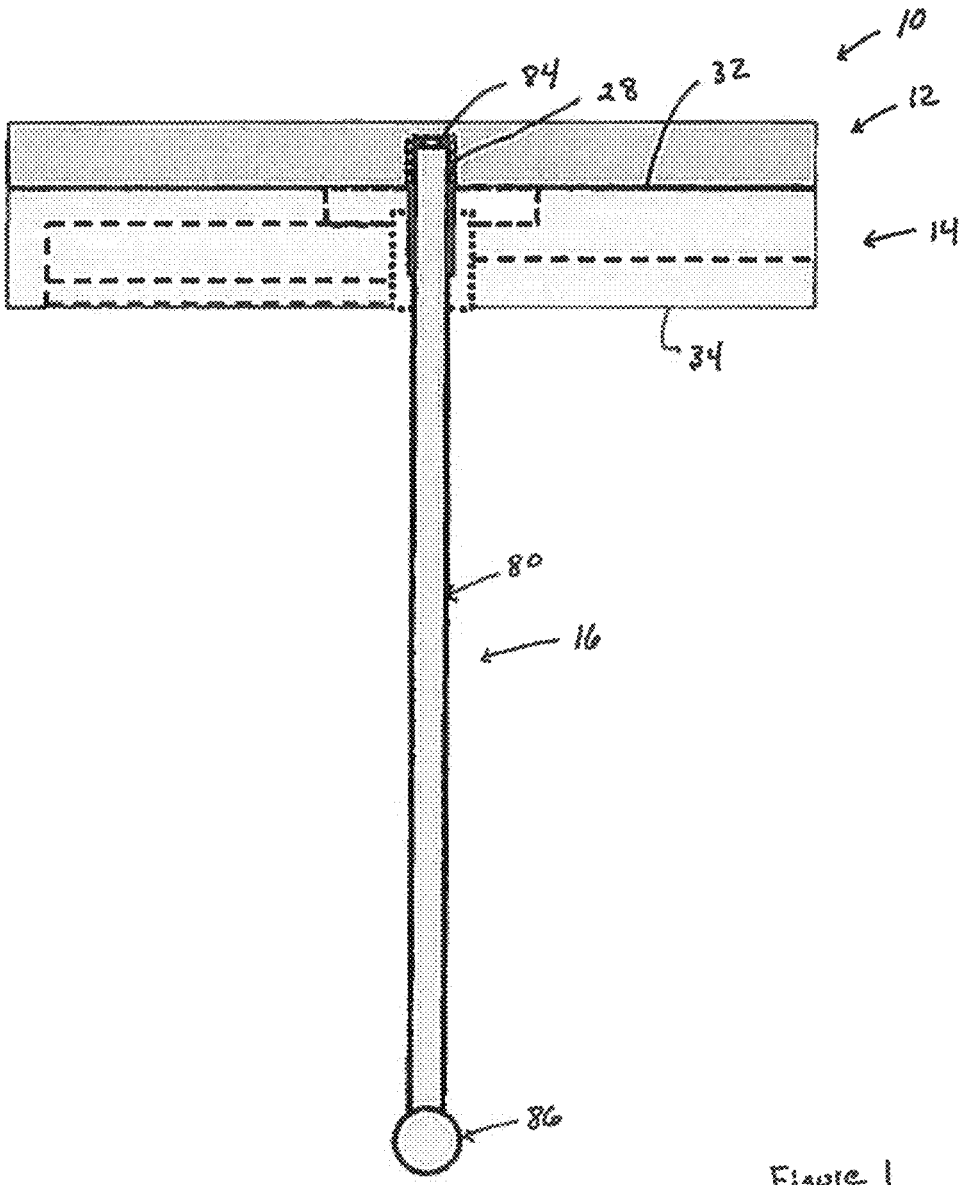
FIG. 1 is a schematic depicting a longitudinal section of an exemplary golf club stand.

The golf club stand of the present invention is used to support a golf club such that a handle of the golf club does not rest upon the ground when the golf club is not in use. Although the stand may be used to support a variety of types, brands, and sizes of golf clubs, and is not limited to the type of golf club with which it is used, the stand is especially preferred to support putters and wedges, such as, e.g., those that are conventionally known.

The golf club stand comprises a mount. In an exemplary embodiment, the mount is fixedly disposed within a cavity that is conventionally formed within an upper portion of a handle of a golf club and which is accessed via an opening formed at a top side of the handle, wherein the top side of the handle is oppositely situated from a head of the golf club. The mount may be fixed within the cavity of the golf club handle via a wide variety of materials and/or methods, including, for example, an adhesive, welding, machining, frictional fit, and the like.

In another exemplary embodiment, the mount may comprise a protrusion that extends from a bottom side of a main body of the mount. In this embodiment, the protrusion may be disposed within the opening formed at the top side of the handle such that a main body of the mount securely rests atop the top side of the handle.

The golf club stand further comprises a rod and a cap. The rod has a longitudinally extending body in which a terminal end of the body of the rod is fixed to the cap, and in which an oppositely situated terminal end of the rod has a stop member disposed thereon. The rod is disposed through a chamber formed through the mount such that the cap is positioned towards a top side of the mount and the stop member is positioned towards a bottom side of the mount, and such that the rod is slidaby engaged with the mount.

When the stand is in a "retracted" position, the cap rests against the top side of the mount. The cap and the mount may be secured to one another when the golf club stand is closed, or retracted, by a wide variety of fastening means, including, for example, a magnet, a clip, a spring, a clasp, a pin, and the like, wherein in an especially preferred embodiment, the mount and the cap are secured to one another via a magnetic force. In this embodiment, a magnet may be disposed on and/or within the mount, and the cap may comprise a magnetic material such as, for example, stainless steel.

When the golf club stand is installed on a golf club, the mount is positioned within the chamber of the handle of the golf club such that the bottom side of the mount is directed towards the head of the golf club. Preferably the top side of the mount is slightly raised relative to the uppermost end of the handle of the golf club. When in a retracted position, the cap rests on the mount and the rod and the stop member are positioned within the chamber of the handle of the golf club.

The golf club stand may be set into an "extended" position by removing the cap from the mount. As the cap is removed from the mount and as the cap is further directed away from the mount, the rod moves through the mount. The mount is configured to prevent the rod from completely disengaging from the mount, and is further configured to orient the rod and the cap relative to the mount such that, when the cap and the head of the golf club are positioned on the ground, i.e., when the golf club stand is in a "folded" position, the golf club handle is raised, thereby preventing the handle from becoming, for example, dirty or wet, and further assisting a user in picking up the golf club.

There has thus been outlined, rather broadly, the more important features of the invention in order that the detailed description thereof that follows may be better understood, and in order that the present contribution to the art may be better appreciated. Any additional features of the invention will be described hereinafter and may form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. Rather, the invention is capable of other embodiments and of being practiced and carried out in various ways. Also, it is to be understood that the phraseology and terminology employed herein are for the purpose of description and should not be regarded as limiting.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Figure 2:
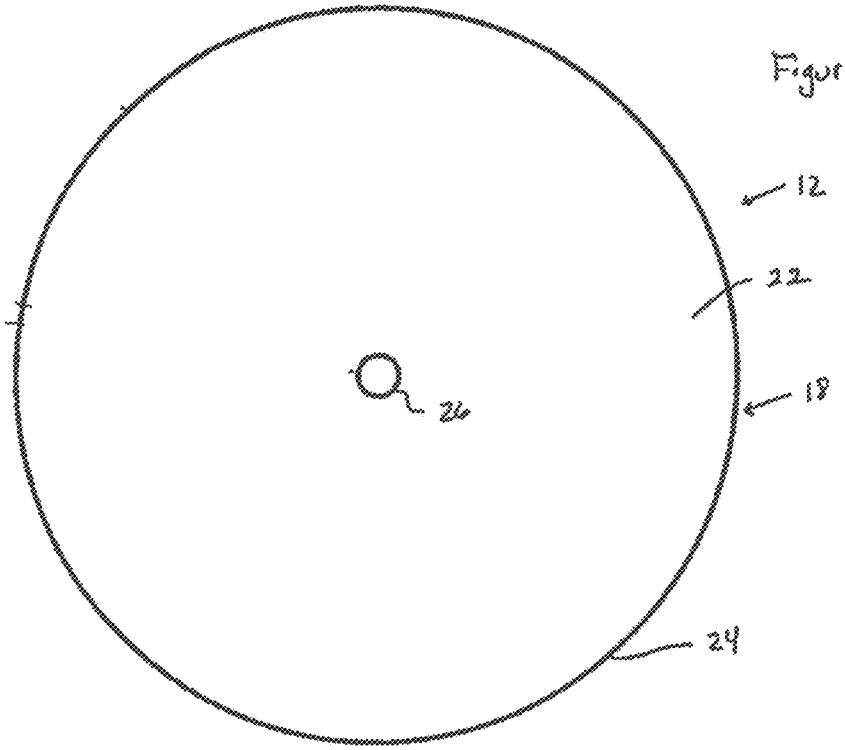
FIG. 2 is a schematic depicting a top surface of an exemplary cap of the stand depicted in FIG. 1.
Figure 3:
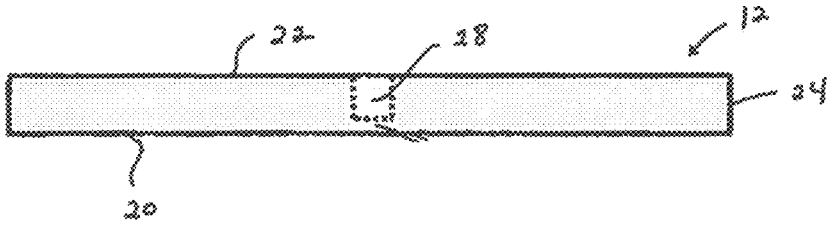
FIG. 3 is a schematic depicting a cross-sectional view of the cap depicted in FIG. 2.

Referring to FIG. 1, an exemplary golf club stand 10 comprises a cap 12, a mount 14, and a rod 16. Referring to FIGS. 2 and 3, cap 12 comprises a body 18. Although body 18 is shown as having a generally disc-like configuration, its configuration is not limited to this embodiment, so long as the configuration of body 18 allows cap 12 to function as generally described herein. Body 18 comprises an upper face 20 oppositely situated to a lower face 22, and a peripheral wall 24 which surrounds upper and lower faces 20 and 22.

An opening 26, which is centrally formed through lower face 22, leads into a chamber 28 having a generally cylindrical configuration.

Although body 18 of cap 12 may be formed from a variety of materials including, for example, one or more of a plastic, a rubber, a metal, and the like, in an especially preferred embodiment, body 18 of cap 12 is formed of a magnetic material, such as, for example, stainless steel.

Figure 4:
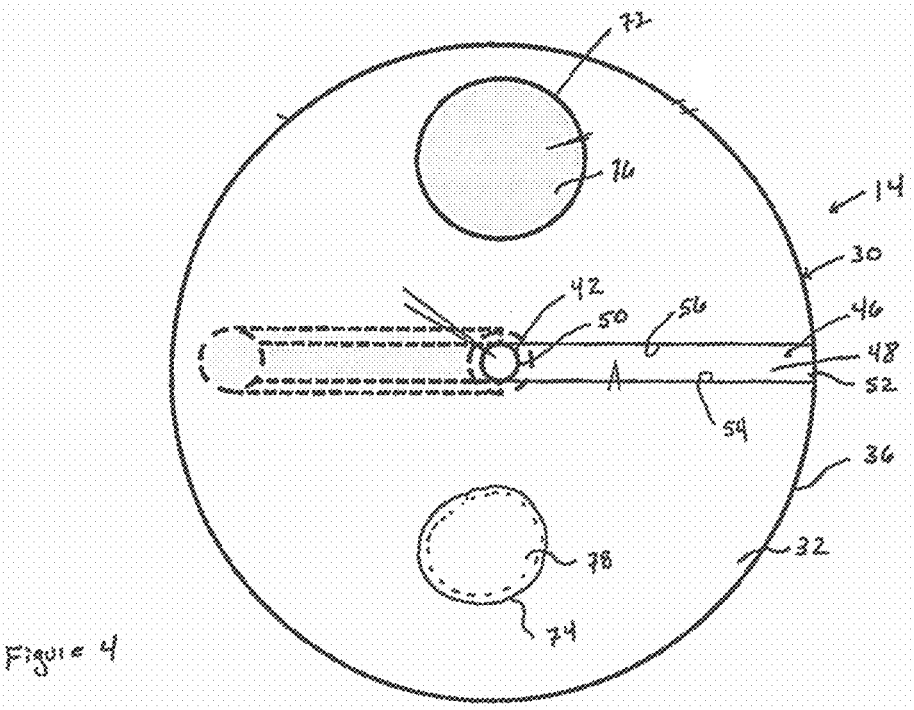
FIG. 4 is a schematic depicting a bottom side view of an exemplary mount of the stand depicted in FIG. 1.
Figure 5:
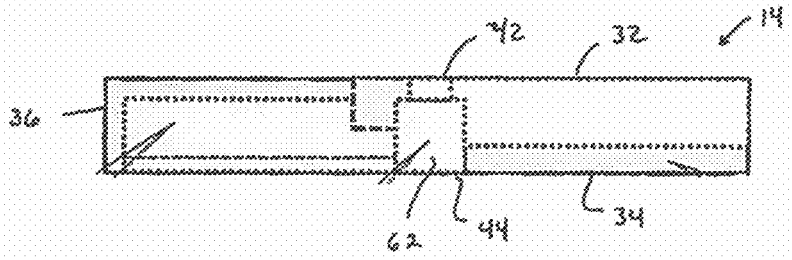
FIG. 5 is a schematic depicting a cross-sectional view of the mount depicted in FIG. 4.
Figure 8:
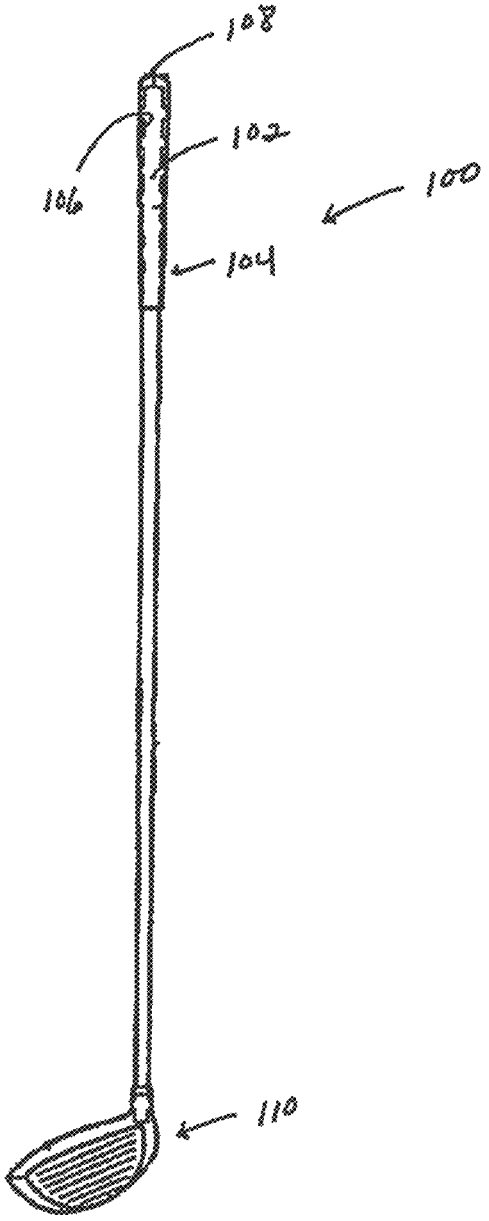
FIG. 8 is a schematic depicting a conventionally known golf club.

Referring to FIGS. 1, 4, and 5, mount 14 comprises a main body 30. Although main body 30 is depicted in the figures as having a generally cylindrical configuration, main body 30 is not so restricted. Rather, the geometrical configuration of main body 30 is only limited to the extent that it can be fitted within a cavity 102 formed in a handle 104 of a golf club 100, wherein an exemplary golf club 100 is depicted in FIG. 8.

Main body 30 comprises a top side 32 oppositely situated to a bottom side 34, and a peripheral wall 36 which surrounds top and bottom sides 32 and 34 at outer edges thereof. Where peripheral wall 36 contacts top side 32, peripheral wall 36 slopes outwardly therefrom to form a lip region 38 of peripheral wall 36. At an opposite end from top side 32, lip region 32 turns substantially perpendicularly towards bottom side 34 to form a neck region 40 of peripheral wall 36, wherein neck region 40 is contiguously and substantially perpendicularly formed with bottom side 34.

Top side 32 of mount 14 has an opening 42 centrally formed thereon, while bottom side 34 has an opening 44 centrally formed thereon. Openings 42 and 44 are coaxial with one another, and opening 44 has an interior diameter greater than an interior diameter of opening 42.

A slot 46 is formed within top side 32. Slot 46 begins at opening 42 and longitudinally extends therefrom into lip region 38 and into neck region 40 where it terminates at neck region 40. Slot 46 is defined in part by a forward intermediate wall 48 that is recessed relative to top side 32 and which is parallel to top and bottom sides 32 and 34, wherein forward intermediate wall 48 has an anterior terminal end 50 oppositely situated to a posterior terminal end 52. Anterior terminal end 50 is directed towards opening 42 and posterior terminal end 52 is located in neck region 40. Anterior terminal end 50 turns substantially perpendicularly towards bottom side 34 to form an interior forward leading wall 58.

Slot 46 is further defined by a proximal side wall 54 and a distal side wall 56, both of which are substantially perpendicular to top side 32 and to forward intermediate wall 48 and both of which are contiguously formed with top side 32 and forward intermediate wall 48.

Figure 7:
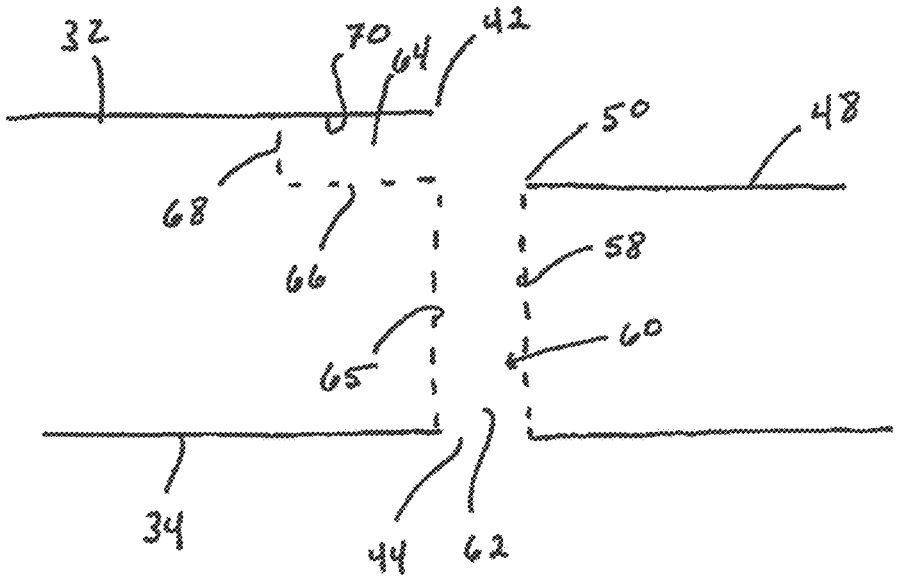
FIG. 7 is a schematic depicting a portion of an interior view of the mount depicted in FIG. 4.

As best seen in FIG. 7, mount 14 further comprises a generally L-shaped chamber 60 which comprises a portion 62 and a portion 64. Portion 62 vertically and continuously extends from opening 42 to opening 44. Portion 62 is immediately adjacent on one side thereof to interior forward leading wall 58, and is immediately adjacent on an oppositely side thereof to an interior rearward leading wall 65, wherein interior rearward leading wall 65 is parallel to interior forward leading wall 58.

Portion 64 is substantially perpendicular to portion 62. Portion 64 is defined by a rearward intermediate wall 66 which is substantially coplanar and parallel with forward intermediate wall 48, by an abutment wall 68 which is substantially perpendicular to rearward intermediate wall 66 and which is directed towards top side 32, and by an underside 70 of top side 32.

Referring again to FIG. 4, bottom side 34 of mount 14 has a recessed portion 72 and a recessed portion 74 formed therein. Recessed portion 72 holds a magnet 76, and recessed portion 74 holds a magnet 78. In an especially preferred embodiment, magnets 76 and 78 are flush with bottom side 34.

Figure 6:
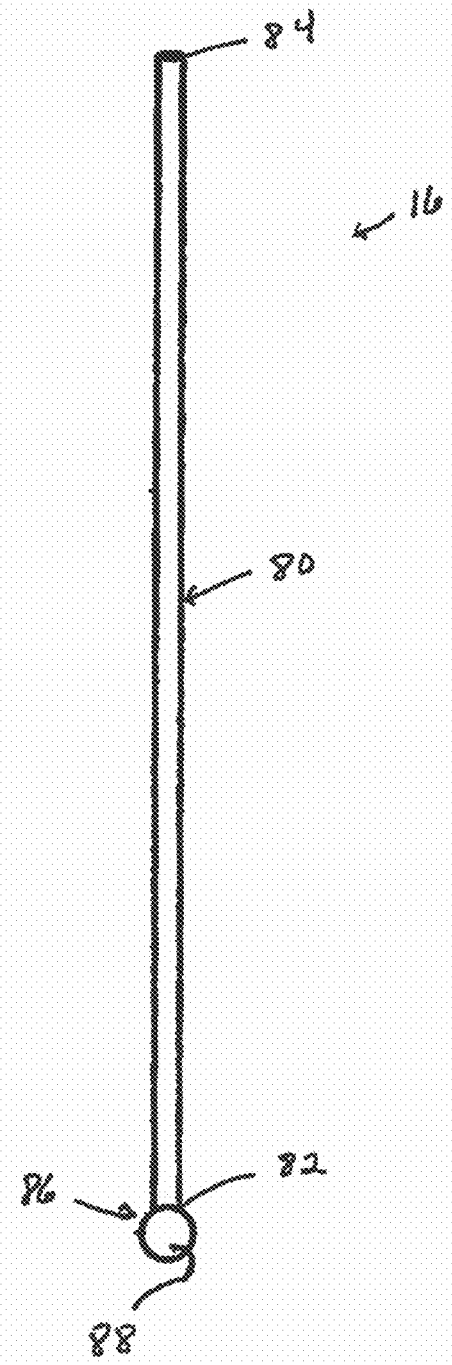
FIG. 6 is a schematic depicting an exemplary rod of the stand depicted in FIG. 1.

Referring to FIG. 6, and as previously mentioned, golf club stand 10 further comprises rod 16. Rod 16 comprises a longitudinally extending body 80 having a generally cylindrical configuration. Body 80 is defined by a posterior terminal end 82 at one end thereof, and by an anterior terminal end 84 at an oppositely situated end thereof. Posterior terminal end 82 has a stop member 86 joined thereto. In an exemplary embodiment, stop member 86 has a bulbous-shaped body 88.

As shown, e.g., in FIG. 1, anterior terminal end 84 of rod 16 is fixedly secured within chamber 28 of cap 12. Mount 14 is slidably engaged with body 80 of rod 16 such that mount 14 is disposed between stop member 86 and cap 12, and further such that bottom side 34 of mount 14 is directed towards stop member 86 and top side 32 of mount 14 is directed towards cap 12.

Referring to FIGS. 7-10, when golf club stand 10 is attached to a golf club 100, golf club stand 10 is positioned on golf club 100 such that rod 16 is positioned within a cavity 102 of a handle 104 of golf club 100, such that stop member 86 is directed towards a head 110 of golf club 100, and such that neck region 40 is physically attached to an interior side wall 106 of golf club 100 which surrounds cavity 102, while lip region 38 is positioned above terminal rim 108 of handle 104, wherein terminal rim 108 defines the uppermost portion of handle 104 and is directed opposite to head 110 of golf club 100.

Figure 9:
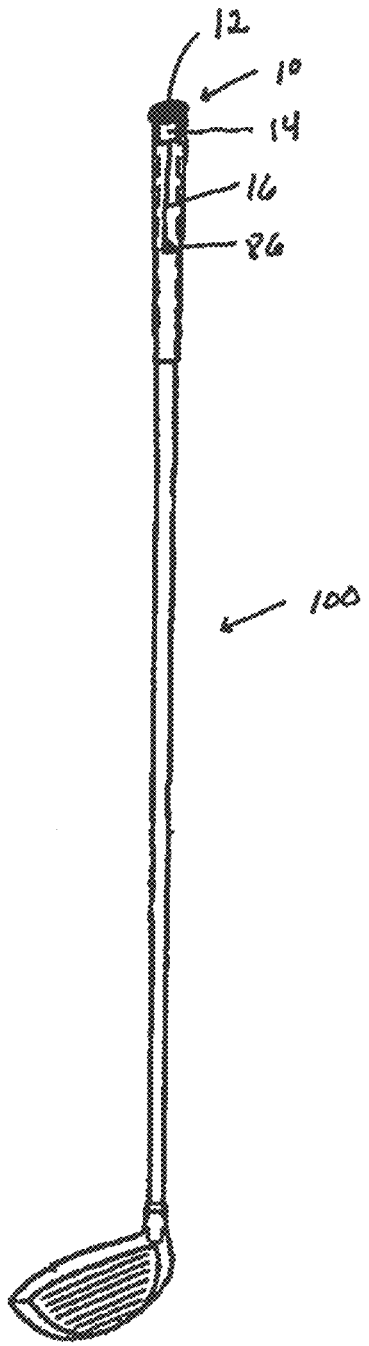
FIG. 9 is a schematic depicting the golf club stand depicted in FIG. 1 installed within the golf club depicted in FIG. 8 and positioned in relation to the golf club in a retracted position.
Figure 10:
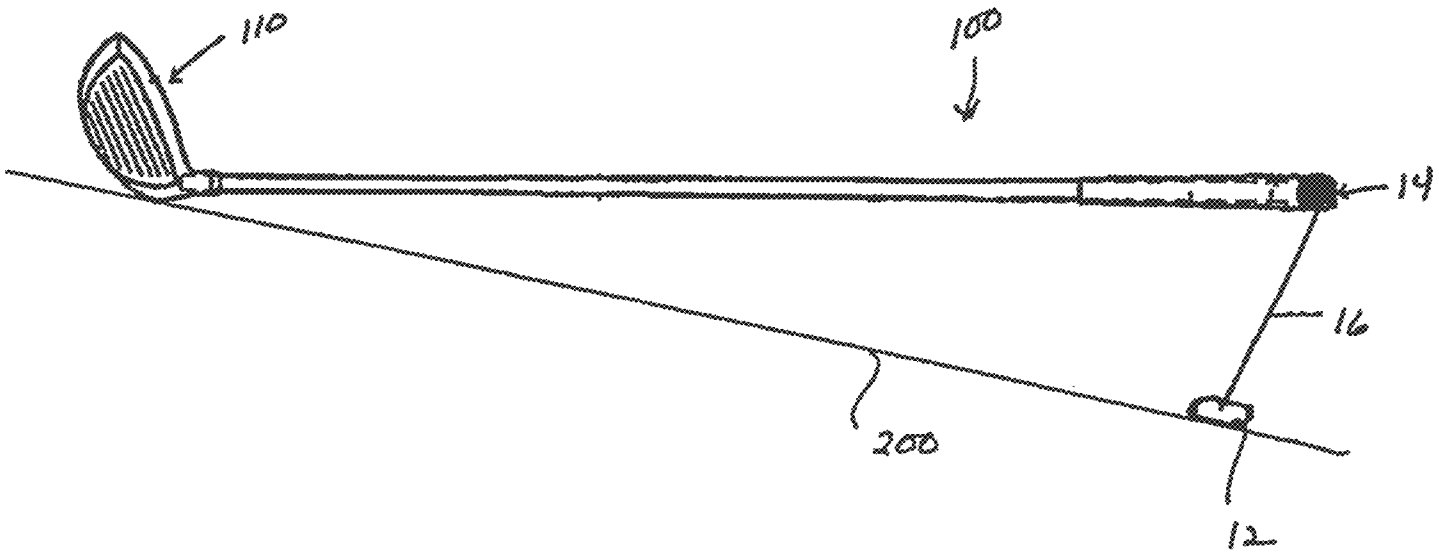
FIG. 10 is a schematic depicting the golf club stand depicted in FIG. 1 installed within the golf club depicted in FIG. 8 and positioned in relation to the golf club in an expanded position.
Figure 11:
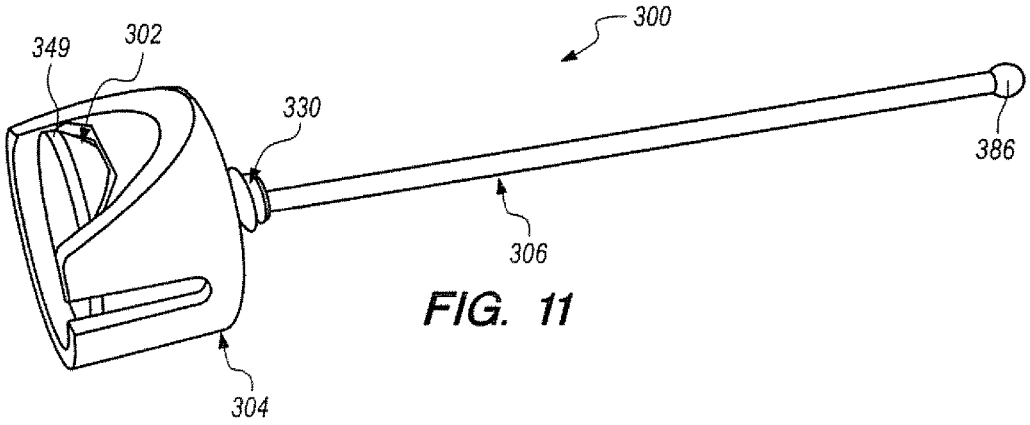
FIG. 11 is a photograph depicting another exemplary golf club stand in a retracted position.
Figure 12:
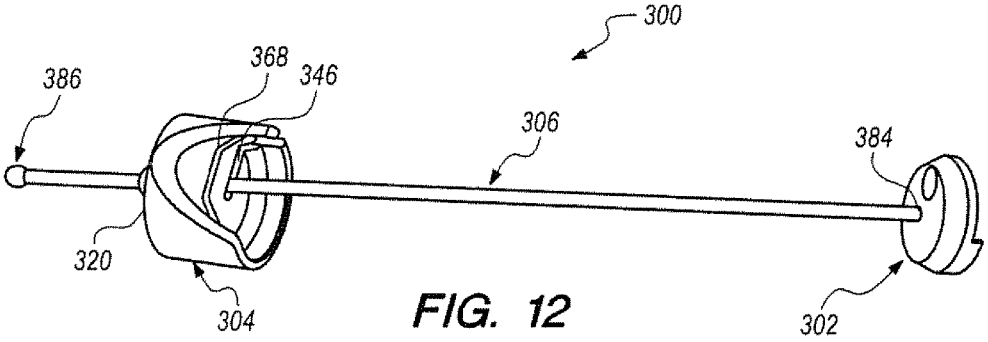
FIG. 12 is a photograph depicting the golf club stand depicted in FIG. 11 in an extended position.
Figure 13:
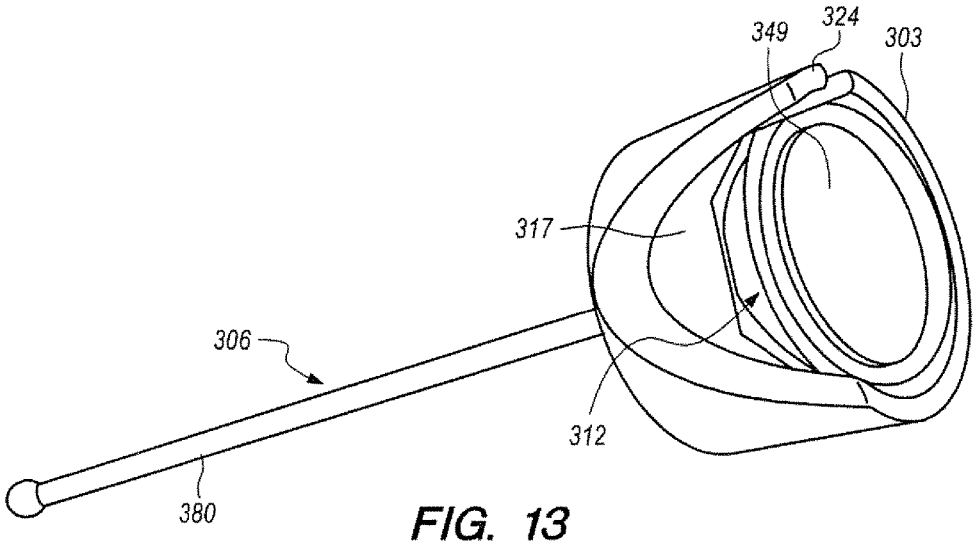
FIG. 13 is a photograph depicting another view of the golf club stand depicted in FIG. 11 in a retracted position.

When golf club stand 10 is in a retracted position as shown, e.g., in FIG. 9, lower face 22 of cap 12 physically abuts top side 32 of mount 14, and is secured thereto via a magnetic force generated by and between body 18 of cap 12 and magnets 76 and 78.

When it is desired to rest golf club 100 against golf club stand 10, a user may exert an upward pull against lower face 22 of cap 12 which exceeds the magnetic force between cap 12 and magnets 76 and 78. Once such force is overcome, a user may then continue to pull cap 12 away from mount 12 such that body 80 of rod 16 and body 88 of stop member 86 pass through opening 42 formed on bottom side 34 of mount 14 and through portion 62 of chamber 60.

Body 88 of stop member 86 is dimensioned such that it has a diameter larger than that of the diameter of opening 42. As such, body 88 of stop member 86 cannot pass through opening 42. Rather, once body 88 reaches opening 42, a force may be directed against peripheral wall 24 of cap 12, thereby moving cap 12 and rod 16 such that body 80 of rod 16 rests against forward intermediate wall 48, proximal side wall 54, and distal side wall 56 of mount 14, and such that bulbous shaped body 88 of stop member 86 is disposed within portion 64 of chamber 60 of mount 14. Stop member 86 is essentially locked in position in this state as bulbous shaped body 88 is held in place by underside 70 of top side 32, and by rearward intermediate wall 66 and by abutment wall 68. Bulbous shaped body 88 is further engaged with mount 14 via a magnetic force generated by and between body 88 of stop member 86 and by magnets 76 and 78. When in the retracted position, lower face 22 of cap 12 may be disposed directly on a ground 200, thereby suspending handle 104 of golf club 100 over ground 200.

When it is desired to again position golf club stand 10 in a retracted position, cap 12 and rod 16 need only be raised towards top side 32 of mount 14, thereby aligning body 88 of stop member 86 with opening 44 of mount 14, and then sliding body 80 of rod 16 through portion 64 of chamber 60 until lower face 22 is disposed on top side 32 of mount 14.

Figure 14:
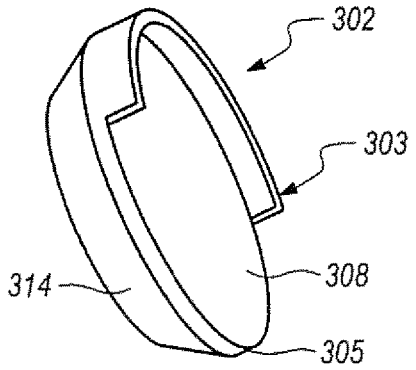
FIG. 14 is a photograph depicting an exemplary cap.
Figure 15:
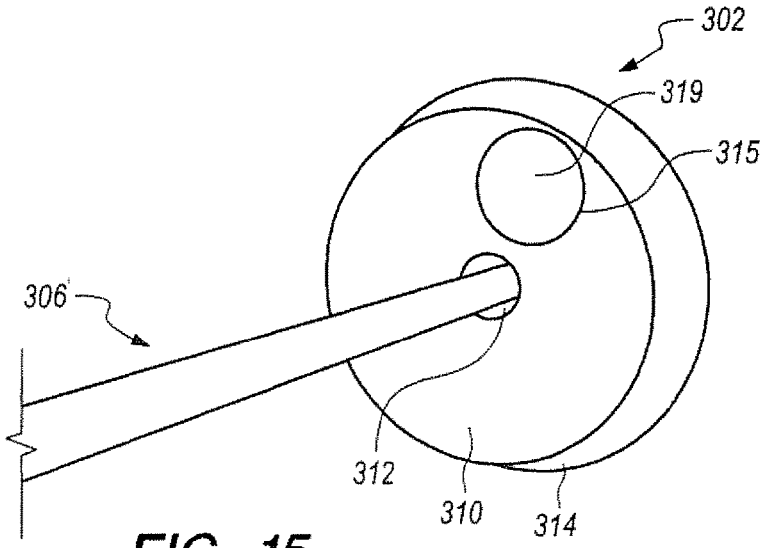
FIG. 15 is a photograph depicting a bottom side of the cap depicted in FIG. 14.
Figure 16:
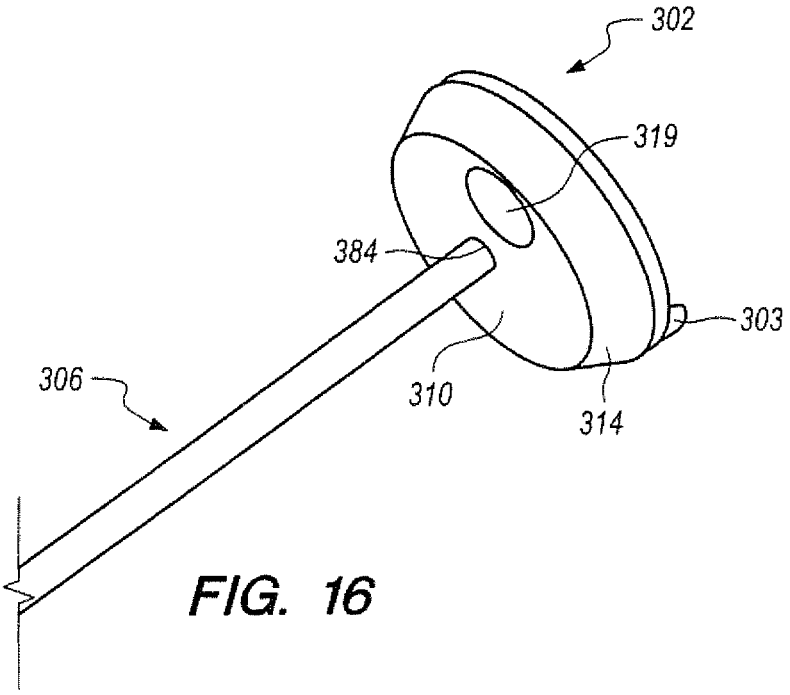
FIG. 16 is a photograph depicting another view of the bottom side of the cap depicted in FIG. 14.

Another exemplary golf club stand is depicted in FIGS. 11-28. Referring to these figures, an exemplary golf club stand 300 comprises a cap 302, a mount 304, and a rod 306. Referring to FIGS. 14-16, cap 302 comprises a generally disc-shaped body having an upper face 308 oppositely situated to a lower face 310. Lower face 310 has an opening 312 centrally formed therein. Lower face 310 further has a recess 315 formed therein wherein recess 315 holds a magnet 319. The body of cap 302 further comprises a peripheral wall 314 disposed between and contiguously formed with the outer edges of upper and lower faces 308 and 310. Peripheral wall 314 tapers inwardly from upper face 308 to lower face 310 such that lower face 310 has a smaller diameter than upper face 308. Cap 302 further comprises a raised wall 303 that extends substantially perpendicularly from upper face 308 and which is contiguously formed with peripheral wall 314. A cutaway portion 305 is formed through raised wall 303 thereby giving raised wall 303 an arced configuration.

Although the body of cap 302 may be formed from a variety of materials including, for example, one or more of a plastic, a rubber, a metal, and the like, in an especially preferred embodiment, the body of cap 302 comprises a magnetic material, such as, for example, stainless steel.

Figure 17:
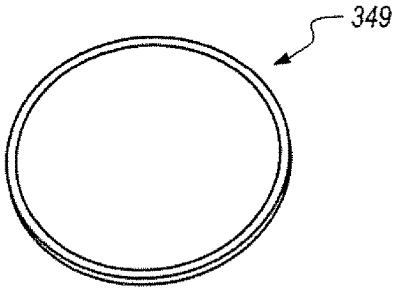
FIG. 17 is a photograph depicting a top side of an exemplary ball marker.
Figure 18:
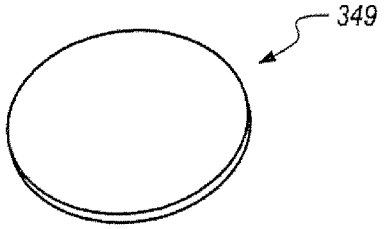
FIG. 18 is a photograph depicting a bottom side of the ball marker depicted in FIG. 17.
Figure 19:
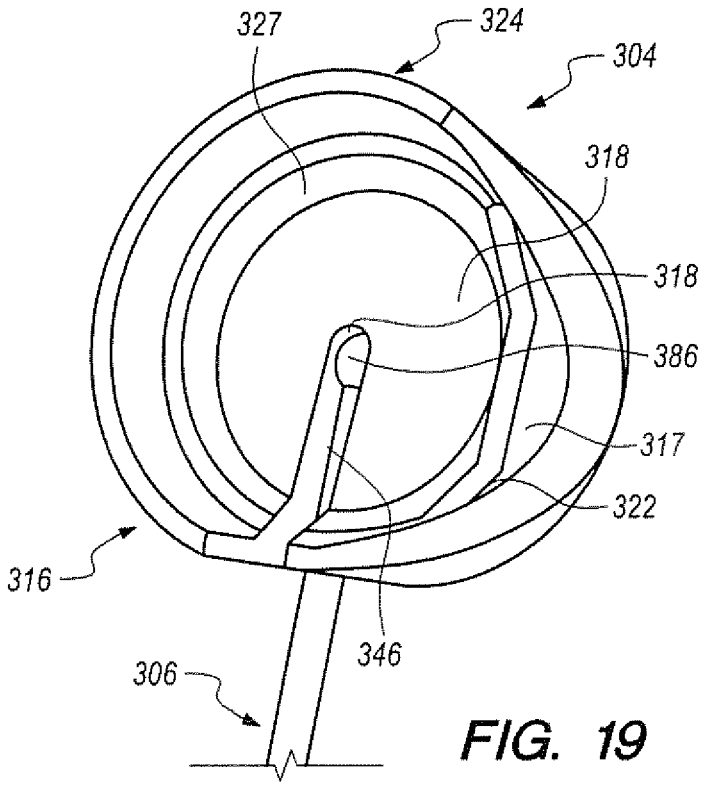
FIG. 19 is a photograph depicting a top side of an exemplary mount.

Referring to FIGS. 17 and 18, an exemplary golf club stand 300 further comprises a ball marker 349 having a generally disc-like configuration. In an exemplary embodiment, ball maker 349 rests on upper face 308 and is secured thereto via, e.g., a magnetic force via magnet 319. Ball maker 349 may be disengaged from upper face 308 by, e.g., sliding ball maker 349 away from upper face 308 and through cutaway portion 305.

As shown, e.g., in FIG. 19-22, mount 304 comprises a body 316. Body 316 comprises a substantially planar top side 318 oppositely situated to a generally concave-shaped bottom side 320. Body 316 further comprises a generally cylindrical-shaped peripheral wall 322 which is contiguously formed with and disposed between top and bottom sides 318 and 320. Peripheral wall 322 extends above top side 318 to form a forward portion 324 such that top side 318 is recessed relative to forward portion 324. Forward portion 324 has on outer wall 325 which is contiguously formed and coplanar with an outer wall 324 of peripheral wall 322. Forward portion 324 has an inner wall 327 oppositely situated from outer wall 325 and directed towards top side 318, wherein inner wall 327 has a generally concave configuration. An opening 329 is formed through forward portion 324 and peripheral wall 322 of body 316.

A chamfered wall 317 is formed through peripheral wall 322 and forward wall 324. Chamfered wall 317 provides a means whereby a user can position the user's finger or thumb against chamfered wall 317 to thereby assist in the release of cap 302 from mount 304.

Top side 318 of mount 304 has an opening 326 centrally formed thereon, while bottom side 320 has an opening 328 centrally formed thereon. Openings 326 and 328 are coaxial with one another and are in fluid communication with one another via a vertically extending channel 362 which is formed through body 316 of mount 304.

A slot 346 is formed within top side 318. Slot 346 longitudinally extends from opening 326 of top side 318 to opening 329. Slot 346 is bordered in part by an intermediate wall 348 that is recessed relative to top side 318 and which is parallel to top and bottom sides 318 and 320, wherein intermediate wall 348 has an anterior terminal end 350 oppositely situated to a posterior terminal end 352. Anterior terminal end 350 is directed towards opening 326 and posterior terminal end 352 terminates at opening 329. Anterior terminal end 350 turns substantially perpendicularly towards bottom side 320 to form an interior forward leading wall 358 (see, e.g., FIG. 24).

Slot 346 is further bordered by a proximal side wall 354 and a distal side wall 356, both of which are substantially perpendicular to top side 318 and to intermediate wall 348 and both of which are contiguously formed with top side 318 and intermediate wall 348.

Figure 24:
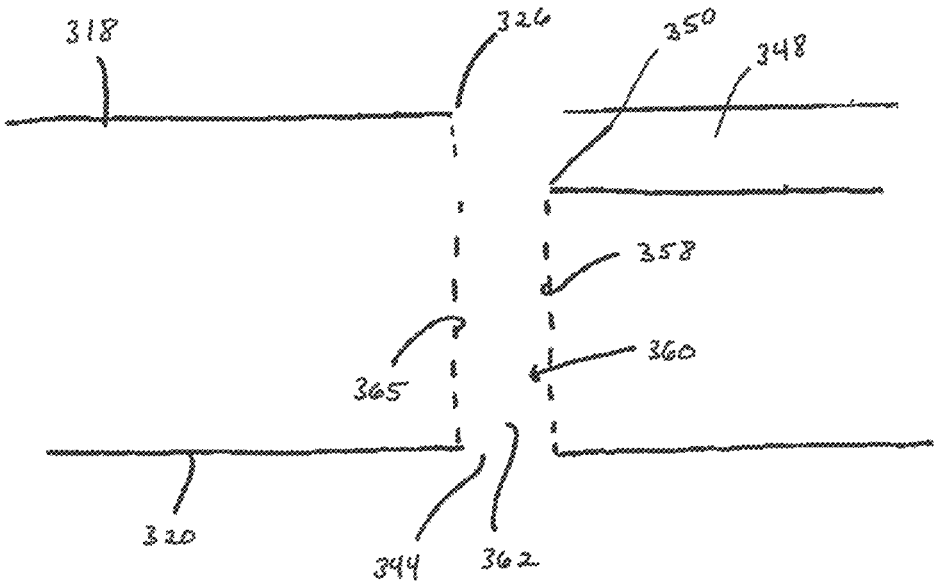
FIG. 24 is a schematic depicting a portion of an interior view of the mount depicted in FIG. 19.
Figure 28:
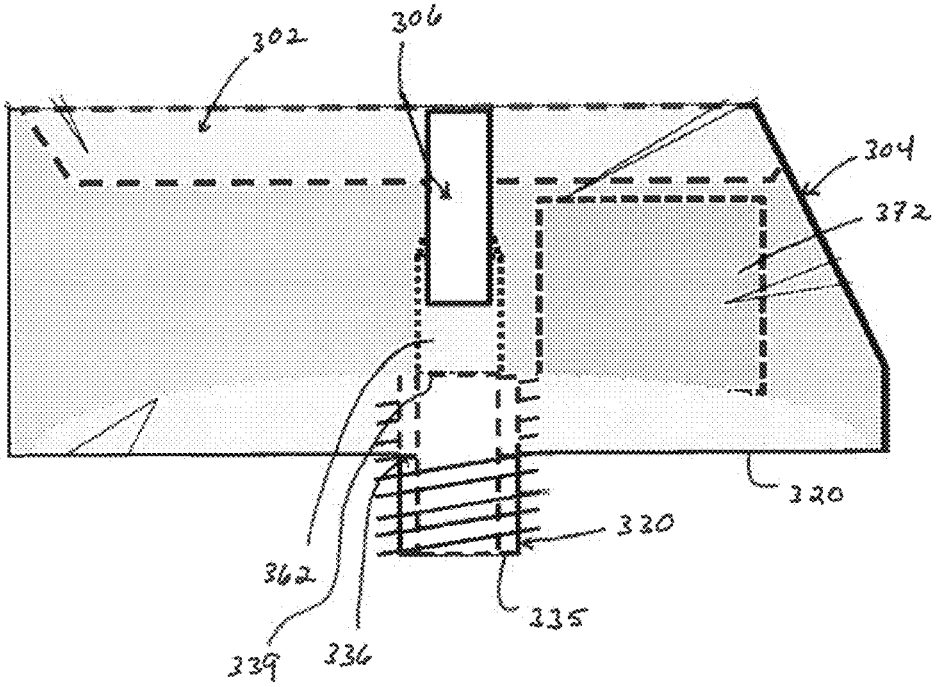
FIG. 28 is a schematic depicting a cross-sectional view of the mount depicted in FIG. 11.

As seen, e.g., in FIGS. 24 and 28, vertically extending channel 332 is immediately adjacent on one side thereof to interior forward leading wall 358, and is immediately adjacent on an oppositely side thereof to an interior rearward leading wall 365, wherein interior rearward leading wall 365 is parallel to interior forward leading wall 358.

Figure 21:
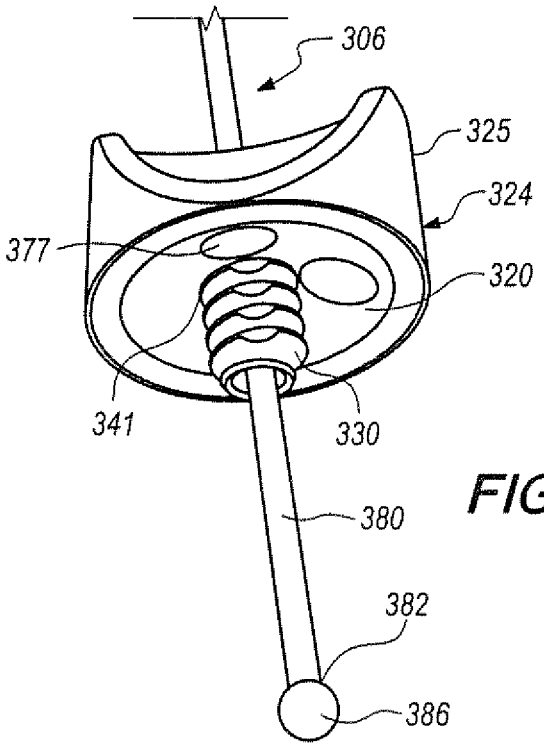
FIG. 21 is a photograph depicting a bottom perspective view of the mount depicted in FIG. 19.
Figure 22:
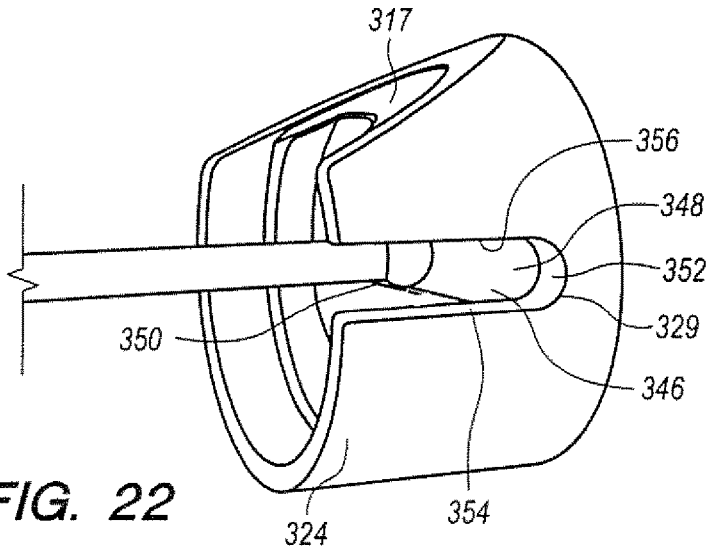
FIG. 22 is a photograph depicting a side view of the mount depicted in FIG. 19.
Figure 23:
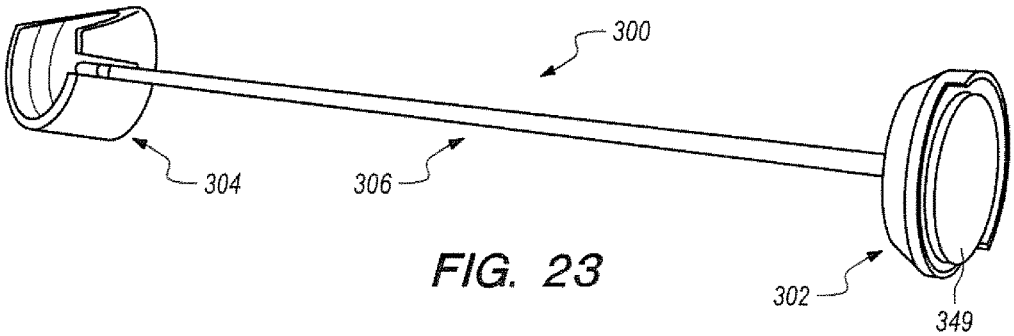
FIG. 23 is a photograph depicting another perspective view of the golf club stand depicted in FIG. 11 in an expanded position.

Referring to FIGS. 21 and 28, e.g., mount 304 further comprises a protrusion such as, e.g., a threaded stud 330, which is centrally disposed on and which linearly extends from bottom side 320. Threaded stud 330 has a generally conical shaped body 333, wherein body 333 has a chamber 336 centrally formed therethrough. Chamber 336 is accessed via an opening 335 formed on a bottom side 337 of body 333 and via an opening 339 formed on a top side 341 of body 333. Chamber 336 is further centrally aligned with channel 362 of chamber 369.

Figure 20:
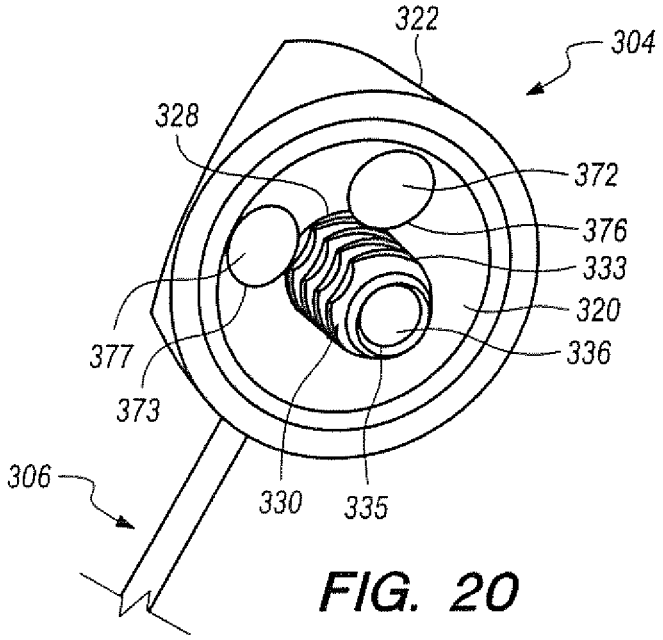
FIG. 20 is a photograph depicting a bottom side of the mount depicted in FIG. 19.

As shown, e.g., in FIGS. 20 and 21, bottom side 320 of mount 304 has a recessed portion 372 and a recessed portion 373 formed therein. Recessed portions 372 and 373 respectively hold magnets 376 and 377. In an especially preferred embodiment, magnets 376 and 377 are flush with bottom side 320.

As previously stated, golf club stand 300 further comprises rod 306. Rod 306 comprises a longitudinally extending body 380 having a generally cylindrical configuration. Body 380 is defined, in part, by a posterior terminal end 382 at one end thereof, and by an anterior terminal end 384 at an oppositely situated end thereof. Posterior terminal end 382 has a stop member 386 joined thereto. In an exemplary embodiment, stop member 386 has a bulbous-shaped body 388.

As shown in the figures, anterior terminal end 384 of rod 306 is fixedly secured within opening 312 of cap 302. Body 390 of rod 306 is disposed through opening 326, channel 362, and opening 344 of mount 304 such that stop member 386 of rod 306 is directed towards threaded stud 330 and anterior terminal end 384 of rod 306 is directed towards top side 318 of mount 304, and such that body 390 of rod 306 is slidably engaged with body 316 of mount 304. Mount 304 is slidably engaged with body 380 of rod 306 such that mount 304 is disposed between stop member 386 and cap 302, and further such that bottom side 320 of mount 304 is directed towards stop member 386 and top side 318 of mount 304 is directed towards cap 302.

Figure 25:
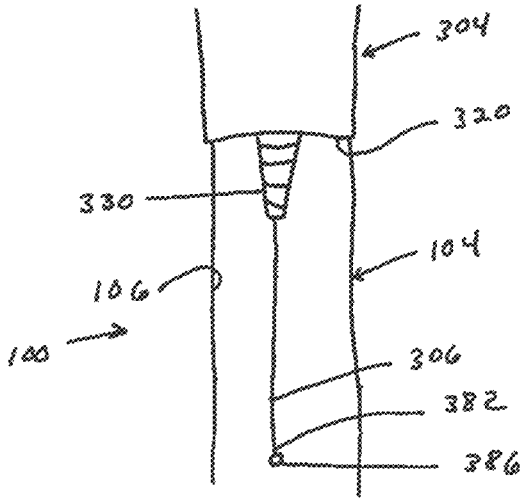
FIG. 25 is a schematic depicting a portion of the golf club stand depicted in FIG. 11 installed within the golf club depicted in FIG. 8 and positioned in relation to the golf club in a "retracted" position.
Figure 26:
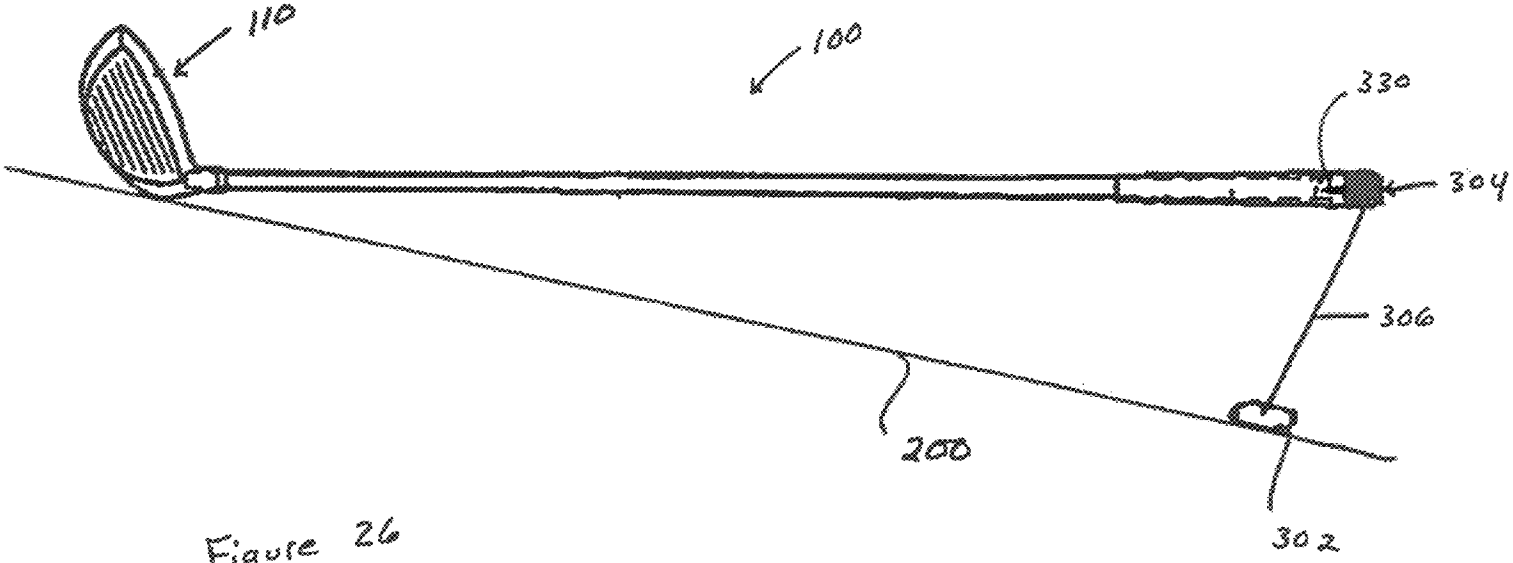
FIG. 26 is a schematic depicting the golf club stand depicted in FIG. 11 installed within the golf club depicted in FIG. 8 and positioned in relation to the golf club in a folded position.
Figure 27:
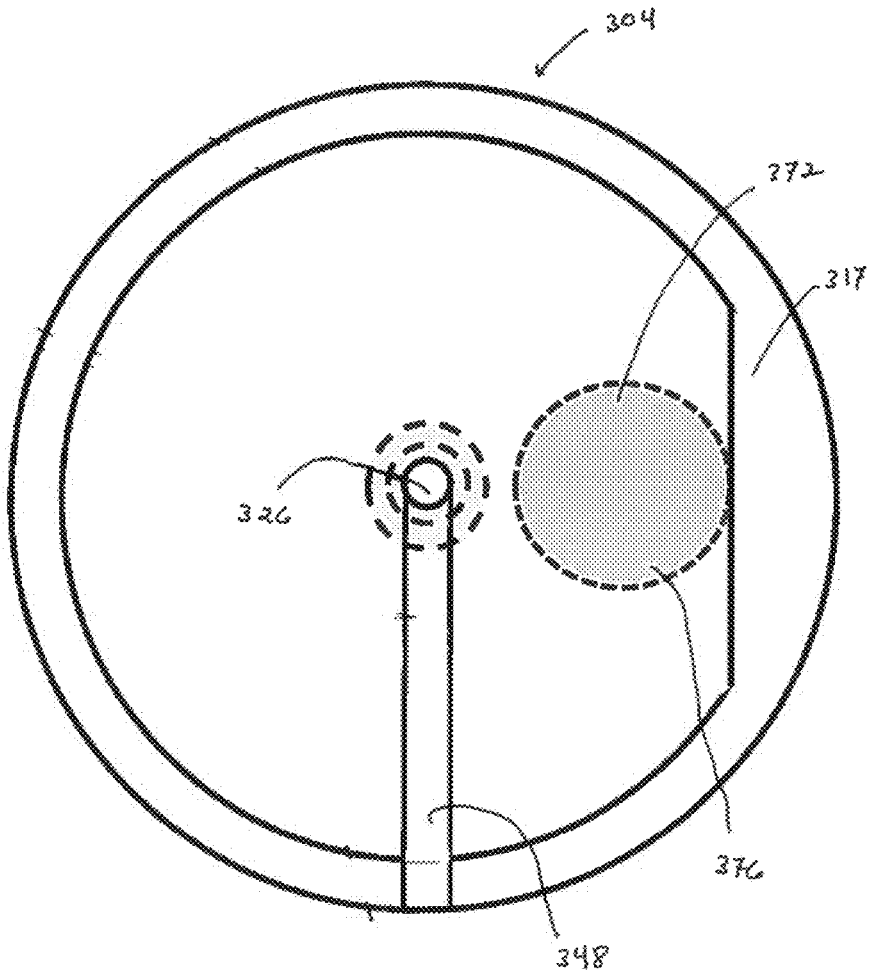
FIG. 27 is a schematic depicting a bottom side view of an exemplary mount of the stand depicted in FIG. 11.

Referring to FIG. 25, golf club stand 300 may be attached to golf club 100 by, e.g., positing golf club stand 300 as shown. Threaded stud 330 may be used to bore a hole in a terminal rim 120 of handle 104 of golf club 100 by, e.g., twisting golf club stand 300 in a clockwise and/or a counterclockwise direction to thereby screw threaded stud 330 through terminal rim 120 until threaded stud 330 seats securedly onto handle 104.

When golf club stand 300 is attached to a golf club 100 such that golf club stand 300 is in a fully retracted position, stop member 386 is positioned within cavity 102 of handle 104 and is directed towards head 110 of golf club 100, rod 306 is positioned within cavity 102, threaded stud 330 is disposed within hole 122 of handle 104, and bottom side 320 of mount 304 is engaged with terminal rim 120 of handle 104. Furthermore, lower face 310 of cap 302 is physically disposed on top side 318 of mount 304 and is held thereto by the magnetic force generated between cap 302 and magnets 376 and 377.

When it is desired to rest golf club 100 against golf club stand 300, a user merely needs to exert an upward pull against lower face 310 of cap 302 which exceeds the magnetic force between cap 302 and magnet 376. Once such force is overcome, a user may then continue to pull cap 302 away from mount 304 such that body 380 of rod 306 and body 388 of stop member 386 pass through opening 326 formed on bottom side 320 of mount 304 and through channel 362 of chamber 360.

Body 388 of stop member 386 is dimensioned such that it has a diameter larger than that of the diameter of opening 326. As such, body 388 of stop member 386 cannot pass through opening 326. Rather, once body 388 reaches opening 326, a force may be directed against peripheral wall 324 of cap 302, thereby moving cap 302 and rod 306 such that body 380 of rod 306 rests against forward intermediate wall 348, proximal side wall 354, and distal side wall 356 of mount 304. Stop member 386 is essentially locked in position in this state as bulbous shaped body 388 cannot pass through opening 326. Bulbous shaped body 388 may be further engaged with mount 304 via a magnetic force generated by and between body 388 of stop member 386 and by magnet 376. When in a folded position, lower face 310 of cap 302 may be disposed directly on a ground 200, thereby suspending handle 104 of golf club 100 over ground 200.

When it is desired to again position golf club stand 300 in a closed, or a retracted, position, cap 302 and rod 306 need only be positioned towards top side 318 of mount 304 such that opening 384 of cap 302 is aligned with opening 326 of mount 304, and then sliding body 380 of rod 306 through vertically extending channel 362 until lower face 310 of cap 302 is disposed on top side 318 of mount 304.

While there is shown and described certain preferred embodiments of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A golf club stand for elevating a handle of a golf club above a around plane, comprising:

a cap, wherein the cap is capable of being arranged such that the cap is able to be directed away from the handle of the golf club, wherein the cap has an upper face oppositely situated to a lower face, wherein the upper and lower faces are interpreted with respect to a longitudinal axis of the handle of the golf club when the golf club is oriented vertically with a club head of the golf club adjacent to the ground plane, and further wherein the lower face has an opening formed therethrough, wherein the cap further comprises a raised wall which vertically extends from the upper face and which has a generally arched configuration, and further wherein the raised wall has a first terminal end oppositely situated to a second terminal end, wherein a gap is created between the first and second terminal ends;

a rod having a longitudinally extending body, wherein the body has an anterior terminal end oppositely situated to a posterior terminal end, wherein the anterior terminal end is received within the opening formed on the lower face of the cap such that the posterior terminal end is oriented away from the cap, wherein the rod is configured and sized to be able to be disposed within the cavity of the handle of the golf club; and a mount having:

a top side oppositely situated to a bottom side, wherein the top and bottom sides are interpreted with respect to the longitudinal axis of the handle of the golf club when the golf club is oriented vertically with the club head of the golf club adjacent to the around plane, and wherein the mount further comprises a peripheral wall which joins the top side to the bottom side, and wherein each of the top and bottom sides has an opening formed thereon;

a longitudinally extending channel which is coaxial with the openings of the top and bottom sides of the mount; and a slot formed through the top side and the peripheral wall of the mount, wherein the slot is in fluid communication with the longitudinally extending channel;

wherein the longitudinally extending body of the rod is interchangeably engaged within the longitudinally extending channel and within the slot;

wherein the mount is configured to engage with a cavity of the handle of the golf club such that the peripheral wall of the mount is physically capable of abutting with the handle of the golf club, and further wherein the golf club stand supports the golf club when the rod is extended from the mount such that the rod is capable of being extended out of the cavity of the handle in a direction opposite to a head of the golf club such that the rod is able to engage the slot.

2. The golf club stand of claim 1, further comprising a ball marker, wherein the ball marker is disposed on the upper face of the cap.

3. The golf club stand of claim 2, further comprising a magnet disposed within the cap, wherein the ball marker is held to the upper face of the cap via a magnetic force created between the magnet and the ball marker.

4. A golf club stand for elevating a handle of a golf club above a around plane, comprising:

a cap having an upper face oppositely situated to a lower face, wherein the upper and lower faces are interpreted with respect to a longitudinal axis of the handle of the golf club when the golf club is oriented vertically with a club head of the golf club adjacent to the ground plane, and further wherein the lower face has an opening formed therethrough, and wherein the cap is capable of being arranged such that the cap is able to be directed away from the handle of the golf club;

a rod having a longitudinally extending body, wherein the body has an anterior terminal end oppositely situated to a posterior terminal end, wherein the anterior terminal end is received within the opening formed on the lower face of the cap such that the posterior terminal end is oriented away from the cap, wherein the rod is configured and sized to be able to be disposed within the cavity of the handle of the golf club; and a mount having;

a top side oppositely situated to a bottom side, wherein the top and bottom sides are interpreted with respect to the longitudinal axis of the handle of the golf club when the golf club is oriented vertically with the club head of the golf club adjacent to the ground plane, and wherein the mount further comprises a peripheral wall which joins the too side to the bottom side, and wherein each of the too and bottom sides has an opening formed thereon, wherein a diameter of the opening of the top side of the mount is smaller than a diameter of the opening of the bottom side of the mount, and further wherein the rod comprises a stop member formed on the posterior terminal end of the longitudinally extending body of the rod, wherein the stop member has a diameter less than the diameter of the opening of the bottom side and less than the diameter of the opening of the top side;

a longitudinally extending channel which is coaxial with the openings of the too and bottom sides of the mount; and a slot formed through the top side and the peripheral wall of the mount, wherein the slot is in fluid communication with the longitudinally extending channel, wherein the slot is contiguously formed with the opening of the top side and the peripheral wall of the mount, and further wherein the slot is formed substantially perpendicularly to the longitudinally extending channel; and wherein the longitudinally extending body of the rod is interchangeable engaged within the longitudinally extending channel and within the slot;

wherein the mount is configured to engage with a cavity of the handle of the golf club such that the peripheral wall of the mount is physically capable of abutting with the handle of the golf club, and further wherein the golf club stand supports the golf club when the rod is extended from the mount such that the rod is capable of being extended out of the cavity of the handle in a direction opposite to a head of the golf club such that the rod is able to engage the slot.

5. The golf club stand of claim 4, wherein the peripheral wall of the mount has a chamfered wall formed thereon.

6. The golf club stand of claim 4, wherein the mount further comprises a protrusion which extends from the bottom side of the mount, wherein the protrusion has a chamber formed therethrough, wherein the longitudinally extending body of the rod is disposed within the chamber of the protrusion and is slidably engaged therewith.

7. The golf club stand of claim 6, wherein the protrusion comprises a threaded stud.

8. The golf club stand of claim 4, wherein, when the golf club stand is in an extended position, the stop member of the rod is disposed within the channel and between the openings of the top and bottom sides of the mount, and the cap is disengaged from the mount while still fixed to the anterior terminal end of the body of the rod such that the opening of the cap is coplanar with the openings of the top and bottom sides of the mount.

9. The golf club stand of claim 4, wherein, when the golf club stand is in a folded position, the stop member of the rod is disposed within the channel and between the openings of the top and bottom sides of the mount, and the longitudinally extending body of the rod is disposed within the slot.

10. The golf club stand of claim 4, wherein, when the golf club stand is in a retracted position, the lower face of the cap physically abuts the top side of the mount, and the longitudinally extending body of the rod is received within the longitudinally extending channel of the mount via the openings on the top and bottom sides, and further wherein the posterior terminal end of the body of the rod is directed away from the bottom side of the mount in a direction opposite to the top side of the mount.

11. The golf club stand of claim 10, further comprising a magnet contained within the mount, wherein the magnet holds the cap to the mount when the golf club stand is in the retracted position.

* * * * *